US009543740B2

(12) United States Patent
Deguchi

(10) Patent No.: US 9,543,740 B2
(45) Date of Patent: Jan. 10, 2017

(54) IGNITION SYSTEM WITH VOLTAGE LIMITING RELATED TO USAGE TIME INCREASE

(71) Applicant: DENSO CORPORATION, Kariya, Aichi-pref. (JP)

(72) Inventor: Masataka Deguchi, Obu (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 14/746,889

(22) Filed: Jun. 23, 2015

(65) Prior Publication Data

US 2015/0372459 A1 Dec. 24, 2015

(30) Foreign Application Priority Data

Jun. 23, 2014 (JP) ..... 2014-128326

(51) Int. Cl.
*H01T 15/00* (2006.01)
*F02P 13/00* (2006.01)

(52) U.S. Cl.
CPC ..... *H01T 15/00* (2013.01); *F02P 13/00* (2013.01)

(58) Field of Classification Search
CPC ..... H01T 15/00
USPC ..... 315/209 T
See application file for complete search history.

(56) References Cited

U.S. PATENT DOCUMENTS

2012/0169244 A1* 7/2012 Kameda ..... F02P 9/007 315/209 CD
2013/0192570 A1* 8/2013 Kajita ..... F02P 15/00 123/596
2013/0199510 A1 8/2013 Shibata et al.
2014/0252976 A1* 9/2014 Hayashi ..... H01T 15/00 315/219
2015/0144101 A1* 5/2015 Deguchi ..... F02P 3/02 123/406.13

FOREIGN PATENT DOCUMENTS

JP 06-80313 10/1994
JP 2011-222242 11/2011
JP 2014-077432 5/2014
JP 2014-173487 9/2014

* cited by examiner

*Primary Examiner* — Dylan White
(74) *Attorney, Agent, or Firm* — Nixon & Vanderhye PC

(57) ABSTRACT

An ignition system has an ignition coil unit, an ignition plug, and a voltage limiter. The ignition coil unit has a primary coil and a secondary coil which are magnetically coupled with each other. The ignition plug has a center electrode and a ground electrode. The ignition plug generates discharge spark between the center and ground electrodes to which voltage is applied on the basis of the magnetic energy accumulated in the ignition coil unit. The voltage limiter limits an absolute value of the voltage applied to the center and ground electrodes of the ignition plug to a voltage limit value. The voltage limiter increases the voltage limit value as cumulative usage time of the ignition plug increases.

5 Claims, 6 Drawing Sheets

IGNITION SYSTEM WITH VOLTAGE LIMITING RELATED TO USAGE TIME INCREASE

CROSS-REFERENCE TO RELATED APPLICATION

This application is based on and claims the benefit of priority from earlier Japanese Patent Application No. 2014-128326 filed on Jun. 23, 2014, the description of which is incorporated herein by reference.

BACKGROUND

Technical Field

This disclosure relates to an ignition system having an ignition plug.

Related Art

Ignition plugs used as ignition means in a combustion chamber of an internal combustion engine are configured to ignite air-fuel mixture by generating discharge spark at spark discharge gaps between center electrodes and the ground electrodes. The discharge spark is repeatedly generated between the center electrode and the ground electrode, which causes wear on the discharge surfaces and the like. Accordingly, the ignition plug deteriorates, depending on the cumulative usage time.

In an initial stage of spark discharge, charge accumulated in stray capacitance between the center electrode and the surrounding housing flows into the spark discharge gap, and thereby capacitive discharge occurs. The wear of the discharge surfaces become advanced as the capacitive discharge current becomes larger. Accordingly, in order to improve the lifetime of the ignition plug, there is a need for reducing the capacitive discharge current.

In order to reduce the capacitive discharge current, the capacitive current PTL1 (Japanese patent application publication No. 2011-222242) has disclosed a method for reducing the stray capacitance of the ignition plug. In the ignition plug of PTL1, a resistor is disposed between the center electrode and a portion forming the stray capacitance for reducing the stray capacitance of the ignition plug.

However, actually there is manufacturing difficulty involved in filling the space with the resistor at a density which enables sufficient effect of reducing the capacitive discharge current to be obtained as described above. Further, in order to produce the foregoing effect, there is a need for providing the resistor at least near the plug tip. However, in this case, the resistor might deteriorate because of heat stress received from combustion in the combustion chamber, which changes the resistance. As a result, it has been difficult to secure ignitability and reduce the capacitive discharge current, and it has not been possible to improve the lifetime of the ignition plug.

SUMMARY

For solving the problems, this disclosure has an object to provide an ignition system which can improve lifetime of an ignition plug.

A method in this disclosure reduces capacitance discharge current by reducing the required voltage.

That is, an aspect according to this disclosure provides an ignition system having an ignition coil unit, an ignition plug and a voltage limiter. The ignition coil unit has a primary coil and a secondary coil which are magnetically coupled with each other. The ignition plug has a center electrode and a ground electrode, and generates discharge spark between the center and ground electrodes to which voltage is applied on the basis of the magnetic energy accumulated in the ignition coil unit. The voltage limiter limits an absolute value of the voltage applied to the electrodes of the ignition plug to a voltage limit value, the voltage limiter increasing the voltage limit value as cumulative usage time of the ignition plug increases, the applied voltage being caused by electrical energy supplied from the ignition coil.

DETAILED DESCRIPTION OF PREFERRED EMBODIMENTS

The ignition device can be used in an internal combustion engine for cogeneration, an internal combustion engine for a vehicle, and the like.

First Embodiment

With reference to FIGS. 1 to 5, a first embodiment of the ignition system is described.

Figure 1:
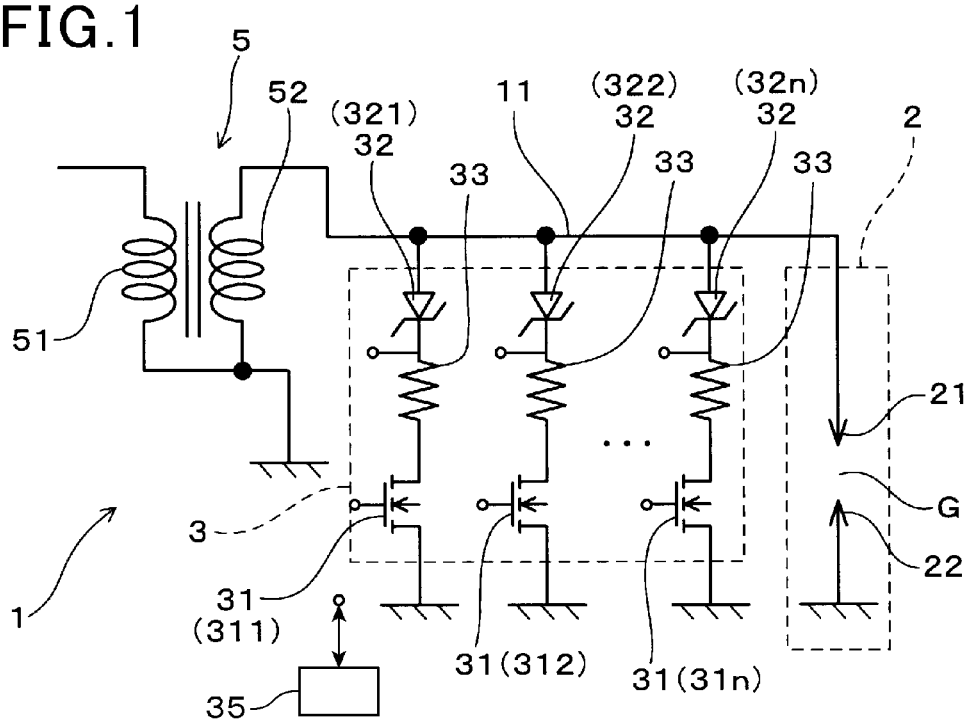
FIG. 1 is a schematic circuit diagram showing an ignition system of a first embodiment.
Figure 2:
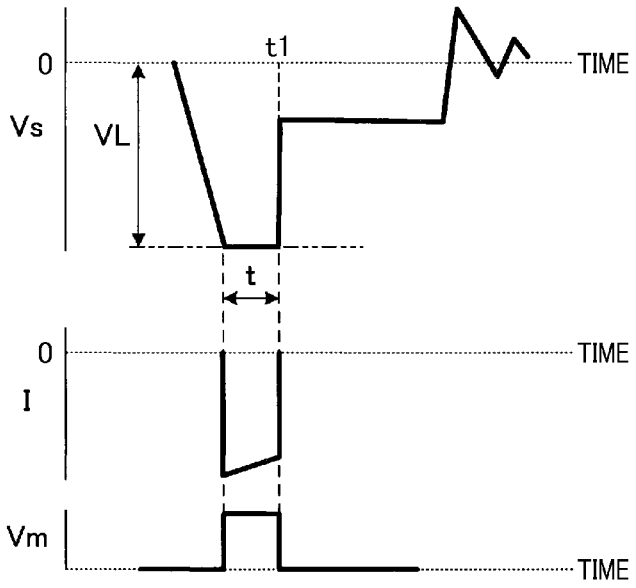
FIG. 2 is a chart showing secondary voltage Vs applied to an ignition plug, electrical current I flowing through a voltage regulating element when capacitive discharge occurs, and voltage Vm which is signal for monitoring, in the first embodiment.

The ignition system 1 of this embodiment has an ignition coil unit 5, an ignition plug 2 and a voltage limiter 3, as shown in FIG. 1.

The ignition coil unit 5 has a primary coil 51 and a secondary coil 52 which are magnetically coupled with each other.

The ignition plug 2 has a first electrode (center electrode) 21 and a second electrode (ground electrode) 22, and generates discharge spark between the electrodes 21 and 22 by applying voltage between them on the basis of the magnetic energy accumulated in the ignition coil unit 5.

Figure 4:
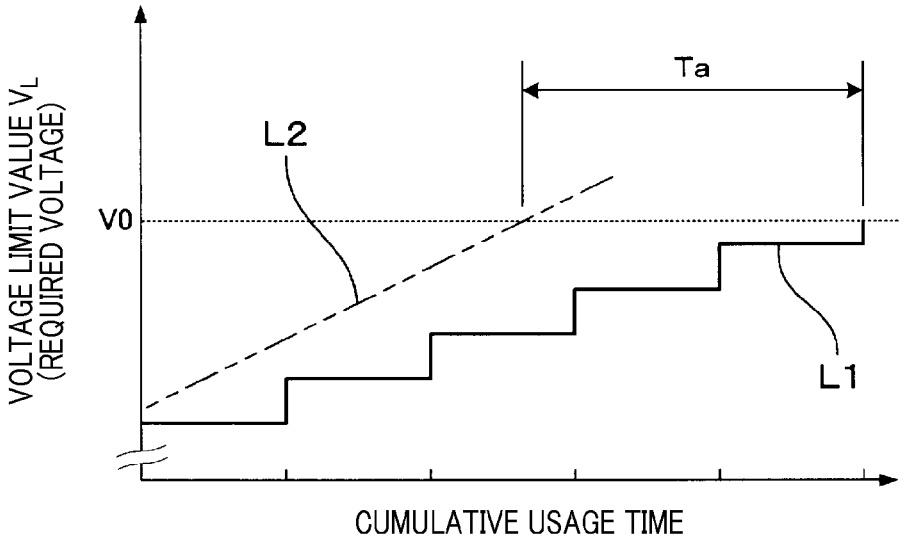
FIG. 4 is a chart showing the relation between cumulative usage time and voltage limit value in the first embodiment.

The voltage limiter 3 limits the voltage Vs applied between the center electrode 21 and ground electrode 22 by supplying electric energy from the ignition coil unit 5 such that the absolute value of the voltage Vs does not exceed a predetermined voltage limit value VL. As shown in FIG. 4, the voltage limiter 3 changes the voltage limit value VL to a larger value, as the cumulative usage time increases.

As shown in FIG. 1, the voltage limiter 3 has switching elements 31, voltage regulating elements 32 and a limiter controller 35. The voltage limiter 3 changes the voltage limit value VL to different values by controlling the switching elements 31 via the limiter controller 35 that output drive signals to the switching elements 31.

The voltage limiter 3 is coupled with a connection wire 11 coupling the ignition coil unit 5 and the ignition plug 2.

In this embodiment, the voltage limiter 3 has a plurality of series units. Each series unit has the voltage regulating element 32, the switching element 31 and a resistor 33 which are coupled in series. The series units are coupled with the connection wire 11 in parallel to the ignition plug 2.

The voltage regulating element 32 is an element through which little electrical current flows when a voltage lower than a specified voltage (breakdown voltage) is applied in the reverse direction. On the other hand, when voltage equal to or larger than the specified voltage is applied in the reverse direction, the electrical current flows through the voltage regulating element 32 such that the voltage drop as large as the specified voltage is generated. As the voltage regulating element 32, a Zener diode can be used. The voltage regulating element 32 is wired such that the anode thereof is on the connection wire 11 side and the cathode is on the ground side. In each series unit, the voltage-constant element 32, the resistor 33 and the switching element 31 are coupled in series in this order from the connection wire 11 side. However, this order is not necessarily limited. As the switching element 31, a MOSFET (metal-oxide-semiconductor field-effect transistor) is used. It should be noted that other elements such as an IGBT (Insulated Gate Bipolar Transistor) can be used as the switching element 31.

The respective voltage-constant elements 32 provided in the series units have specified voltages different from each other. That is, the specified voltage V2 of the voltage regulating element 322 in the second series unit is larger than the specified voltage V1 of the voltage regulating element 321 in the first series unit, and the specified voltage Vn of the voltage regulating element 32*n* in the n th (n is a natural number which is 3 or larger) series unit is further larger. In this embodiment, the voltage limiter 3 has three or more series units. This enables to change the voltage limit value VL to three or more levels (V1, V2, . . . , Vn).

Using the voltage limiter 3 having the above-described configuration can limit the absolute value of the voltage Vs (secondary voltage Vs) applied between the electrodes of the ignition plug 2 by supplying the electric energy from the ignition coil 5 to the voltage limit value VL or less. The voltage limiter 3 can change the voltage limit value VL to a higher value as the cumulative usage time increases of the ignition plug 2.

Figure 3:
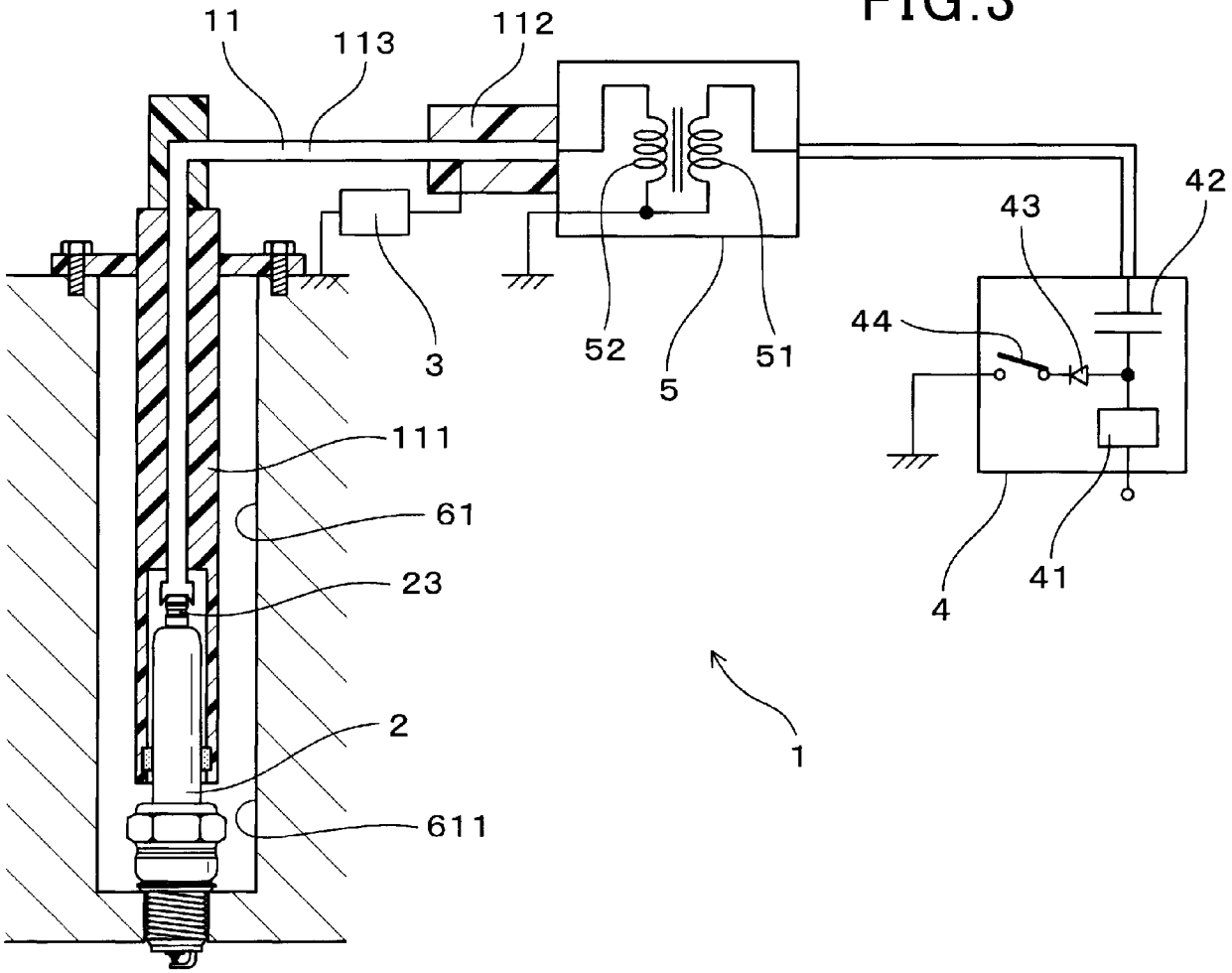
FIG. 3 is a schematic view showing the ignition system of the first embodiment including an ignition controller.

As shown in FIG. 3, the connection wire 11 coupling the ignition plug 2 and the ignition coil 5 is formed as a high tension cable. The connection wire 11 has a rod portion 111, a connector portion 112, and a harness portion 113 between the rod portion 111 and the connector portion 112. The rod portion 111 is coupled with the secondary coil 52 of the ignition coil 5, is inserted to a plug hole 611 of an engine head 61 of the internal combustion engine to which the ignition coil 2 is attached, and is coupled with a terminal 23 of a base end of the ignition plug 2. The connector portion 112 is coupled with the ignition coil 5.

In this embodiment, the voltage limiter 3 is coupled with the connector portion 112 in the high tension cable (connection wire 11), and is connected to the engine head which is the earth. The ignition system 1 is a system used in an internal combustion engine for cogeneration.

The ignition plug 2 has the center electrode 21 and the ground electrode 22 having a spark discharge gap G therebetween. A noble metal tip is provided at the tip of the center electrode 21. Another noble metal tip may be provided at a surface of the ground electrode 22, the surface facing the center electrode 21.

The primary coil 51 of the ignition coil 5 is coupled with an ignition controller 4. The ignition controller 4 has a DC-DC converter 41 and an electrical capacitor. The DC-DC converter 41 boosts a power supply voltage to a predetermined voltage level. The capacitor 42 is electrically connected between the DC-DC converter 41 and the primary coil 51. Further, a ground wire is provided from a wire between the DC-DC converter 41 and the capacitor 42, and the ground wire is grounded through a diode 43 and a switching element 44.

After making the switching element 44 be OFF state to accumulate charge in the capacitor 42, the ignition controller 4 switches the switching element 44 on at a predetermined timing, which allows electrical current to flow to the primary coil 51 of the ignition coil 5. This induces the secondary voltage Vs in the secondary coil 52 of the ignition coil 5. The secondary voltage Vs is applied to the ignition plug 2 and the voltage limiter 3.

An example of actuation and functions of the voltage limiter 3 is described.

For example, in an initial state where the ignition plug 2 is new, only the switching element 311 of the first series unit is made ON state, and the switching elements of the other series units are made OFF state. Thus, only the first series unit of the series units is connected in parallel to the ignition plug 2, the voltage limit value VL becomes the specified voltage V1 of the voltage regulating element 321 of the first series unit. That is, the voltage limit value VL can be set at a comparatively low level. Thus, the required voltage can be reduced, which causes the capacitive discharge current to lower, thereby wear of the ignition plug 2 can be suppressed.

Further, when a certain cumulative usage time of the ignition plug 2 has elapsed, the ignition plus 2 is deteriorated because of increase in size of the spark discharge gap G, which causes spark discharge to become less likely to occur. Accordingly, the voltage limiter 3 makes only the switching element 312 of the second series unit be ON state, and makes the other switching elements 31 including the switching element 311 of the first series unit be OFF state. This changes the voltage limit value VL to the specified value V2 of the voltage regulating element 32 of the second series unit. Accordingly, the secondary voltage Vs applied to the ignition plug 2 can be increased, which can secure ignitability of the ignition plug 2.

The timing for changing the voltage limit value VL can be determined on the basis of the length of the duration t (see FIG. 2) for which the electrical current flows to the series unit. That is, when the secondary voltage Vs applied to the voltage regulating element 32 becomes the specified voltage (the voltage limit vale VL) or more, the electrical current I flows to the voltage regulating element 32. At this time, the voltage applied between the electrodes of the ignition plug 2 is held at the specified voltage (voltage limit value VL). After that, until the spark discharge occurs at the spark discharge gap G (at time t1), it takes a certain duration. During the holding duration, the electrical current I flows to the series (the voltage regulating element 32). That is, the holding duration is the above-described duration t. If the holding duration t is longer than a predetermined duration, the ignition plug 2 might misfire. Accordingly, when the holding duration t exceeds the predetermined duration, the voltage limiter 3 can determine the voltage limit value VL is too low. At this timing, the voltage limiter 3 switches the switching elements 31 on or off to switch the voltage regulating element 32 which is connected in parallel to the ignition plug 2, thereby changing the voltage limit value VL.

The holding duration t can be measured by monitoring a voltage Vm applied to both ends of the resistor 33 of each series unit. That is, while the electric current flows to the voltage regulating element 32, the electric current also flows to the resistor 33, which causes voltage drop in the resistor 33. The voltage limiter 3 can monitor the voltage Vm of the resistor 33 to measure the holding duration t. In this embodiment, the limiter controller 35 is electrically connected to the ends of the resistors 33 to receive the signals from the resistors, has a timer (not shown) counting the holding duration t on the basis of the signals from the resistors, and determines whether to change the voltage limit value VL.

As the cumulative usage time of the ignition plug 2 increases, the spark discharge gap G becomes larger. Accordingly, there occurs a need for further increasing the voltage limit value VL. In response to this, the voltage limiter 3 switches the switching elements 31 on or off to produce a state where only the series unit which includes the voltage regulating element 32 having the larger specified voltage is connected in parallel to the ignition plug 2. Thus, as shown in the polygonal line L1 of FIG. 4, the voltage limiter 3 stepwisely increases the voltage limit value VL depending on increase in cumulative usage time of the ignition plug 2. This enables the ignition system 1 to be used for a long time effectively.

In FIG. 4, the polygonal line L1 shows the relation between the cumulative usage time and the voltage limit value VL. The line L2 shows the relation between the cumulative usage time of the ignition plug 2 and the required voltage, when the voltage limiter 3 is not provided. As shown in FIG. 4, in this embodiment, from the initial stage of the lifetime of the ignition plug 2, the voltage limit value VL is set at a value smaller than the required voltage of the ignition plug when the voltage limiter 3 is not provided, i.e. voltage at which capacitive spark discharge occurs when the voltage limiter 3 is not provided. Even if such voltage limit value VL is set, the voltage is applied and held to advance ionization in the spark discharge gap G, and thereby spark discharge can be generated.

Next, the effects of this embodiment are described.

The ignition system 1 can reduce the required voltage of the ignition plug 2, because it has the voltage limiter 3. As a result, the capacitive discharge current can be reduced, which can prevent wear of the discharge surfaces of the center electrode 21 and the ground electrode 22.

The voltage limiter 3 is configured to increase the voltage limit value VL as the cumulative usage time of the ignition plug 2 increases. Although reducing the capacitive discharge current can suppress wear of the electrodes, the electrodes cannot be avoided from wearing gradually. If the electrodes wear, the spark discharge gap G gradually becomes larger, which increases the required voltage. If the voltage limiter 3 keeps the voltage limit value VL at the low level, misfire occurs early, which prevents improvement of the lifetime of the ignition plug 2.

Accordingly, the voltage limiter 3 is configure to increase the voltage limit value VL as the cumulative usage time of the ignition plug 2 increases. This enables spark discharge in the ignition plug 2, even if the spark discharge gap G expands. As a result, the lifetime of the ignition plug 2 can be improved effectively.

Figure 5:
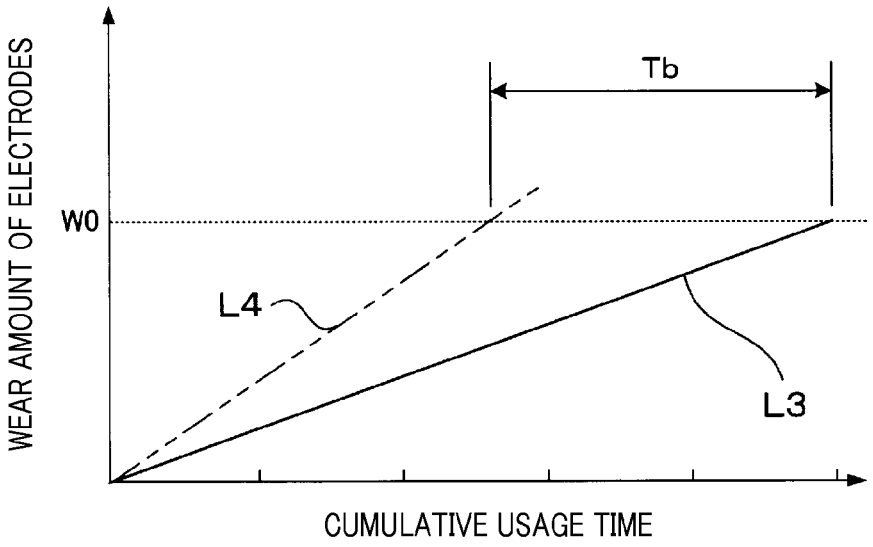
FIG. 5 is a chart showing the relation between cumulative usage time and wear amount of electrodes in the first embodiment.

In FIG. 5, the line L3 shows the relation between the cumulative usage time of the ignition plug 2 and the amount of wear of the electrodes, when the ignition system 1 of this embodiment is used. The line L4 shows the relation between the cumulative usage time of the ignition plug 2 and the amount of wear of the electrodes as a comparison, when the voltage limiter 3 is not provided. As shown in FIG. 5, wear speed of the electrodes in the case (L3) where the voltage limiter 3 is provided is smaller than that in the case (L4) where the voltage limiter 3 is not provided, since the voltage limit value VL is set. As a result, wear of the electrodes can be suppressed significantly, and the lifetime of the ignition plug 2 can be lengthened.

Tb shown in FIG. 5 shows the length of the lifetime, the length being elongated by the ignition system 1 of this embodiment. Here, in FIG. 5, the time until the amount of the electrodes reaches a predetermined amount W0 of the electrodes is considered as the lifetime of the ignition plug 2. Also, Ta shown in FIG. 4 shows the length of the lifetime, the length being elongated by the ignition system 1 of this embodiment. Here, in FIG. 4, the time until the required voltage reaches a predetermined voltage V0 is considered as the lifetime of the ignition plug 2. It will be noted that FIG. 4 and FIG. 5 show not actual measured data, but theoretically-derived schematic graph for describing the effects.

The voltage limiter 3 has the switching elements 31 and the voltage regulating element 32, and is configured to switch the voltage limit value VL to different values. Accordingly, the voltage limit value VL can be changed readily and reliably.

The voltage limiter 3 can change the voltage limit value VL to three or more levels. Accordingly, ignitability can be secured and the electrodes can effectively be prevented from wearing. As a result, the lifetime of the ignition plug 2 can be improved effectively.

The voltage limiter 3 is connected to the connection wire connecting the ignition coil 5 and the ignition plug 2. Accordingly, the lifetime of the ignition plug 2 can be readily improved without especially changing structures of the ignition coil 5 and the ignition plug 2 or the like.

As described above, this embodiment can provide an ignition system having an ignition plug whose lifetime is improved.

Second Embodiment

Figure 6:
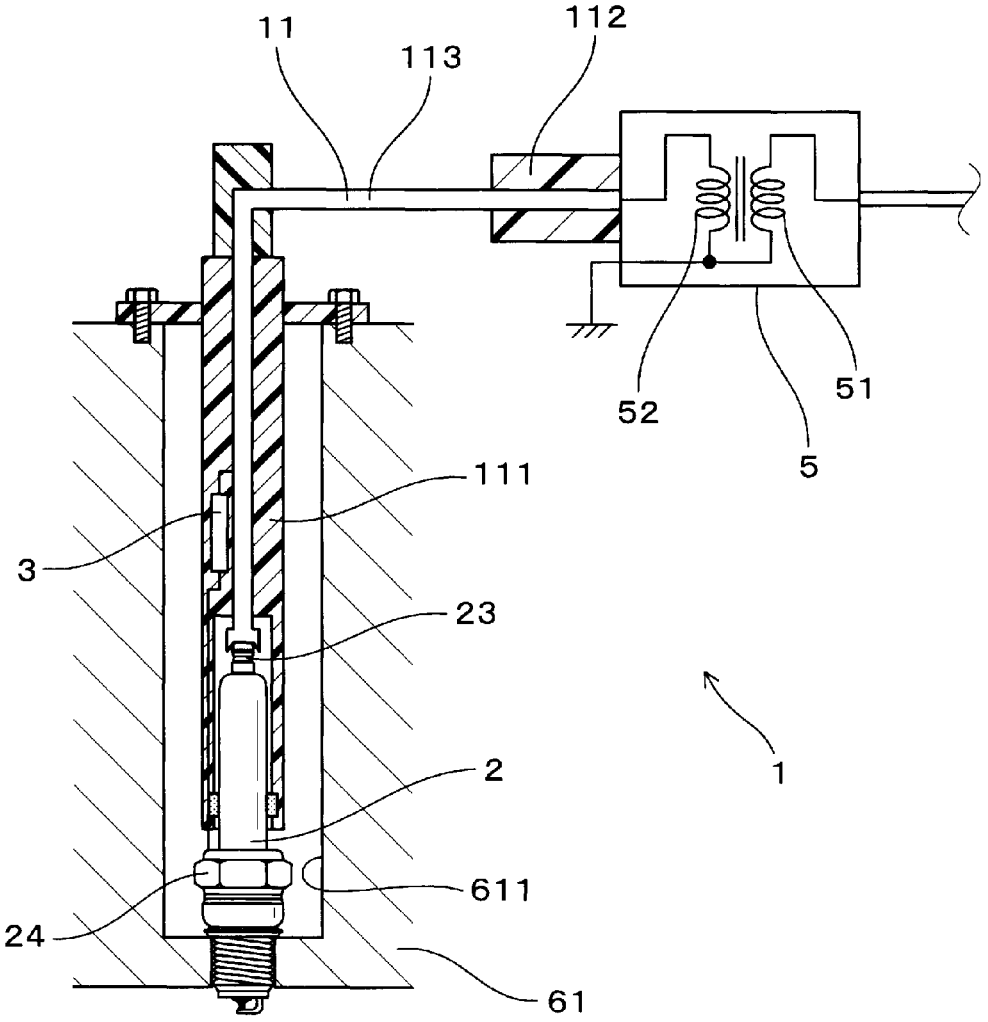
FIG. 6 is a schematic view showing an ignition system of a second embodiment.

This embodiment, as shown in FIG. 6, is an example of the ignition system 1 having the high tension cable (connection wire 11) with a built-in voltage limiter 3. The voltage limiter 3 is provided in the rod portion 111 of the connection cable 11.

In this embodiment, the voltage limiter 3 has a first terminal on the ground side and a second terminal on the connection wire side, and the first terminal is connected to a housing 24 of the ignition plug 2. The second terminal of the voltage limiter 3 is electrically connected to the connection wire 11 in the rod portion 111.

Other configurations are the same as the first embodiment. It will be noted that, of the symbols used in the description and the drawing of this embodiment, the same symbols are used for the same elements as the first embodiment unless otherwise noted.

In this embodiment, providing the voltage limiter 3 in the rod portion 111 can improve workability for attaching the ignition system 1 to the internal combustion engine. Otherwise this embodiment has the same effects as the first embodiment.

Third Embodiment

Figure 7:
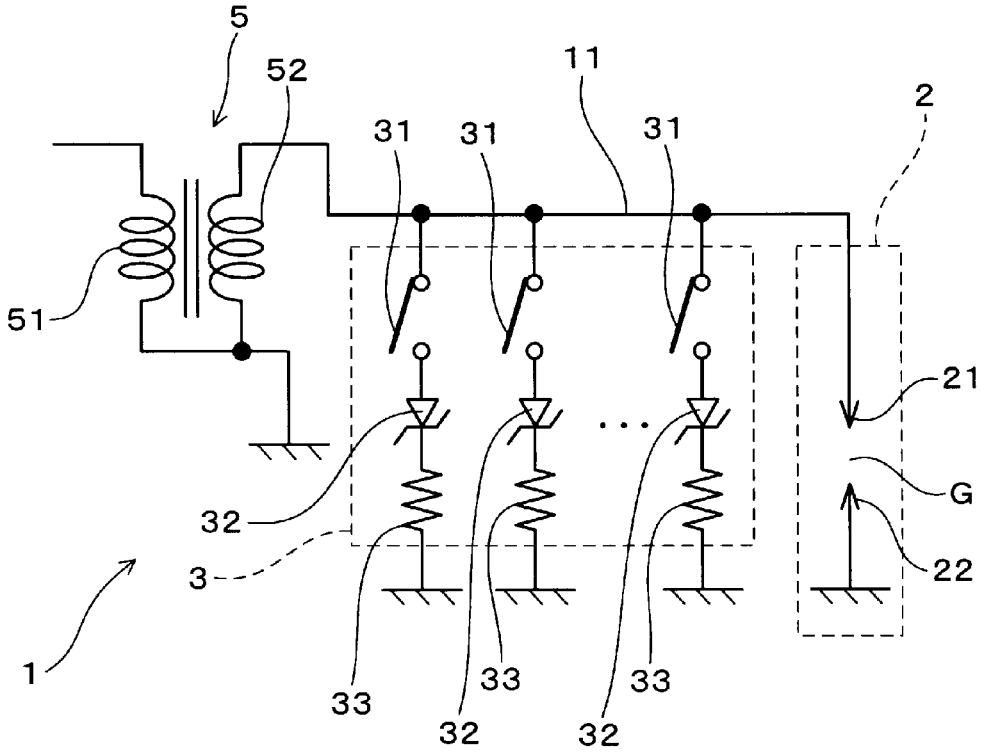
FIG. 7 is a schematic circuit diagram of an ignition system of a third embodiment.

This embodiment is an example where the switching element 31 is closer to the terminal on the connection wire 11 side than the voltage regulating element 32 is, as shown in FIG. 7.

That is, in each series unit, the switching element 31 is connected at a position closer to the ignition coil 5 than a position where the voltage regulating element 32 is connected is. In this case, if a MOSFET or an IGBT is used as the switching element, high voltage is applied to the base terminal, which might damage a controller such as an engine ECU which is connected to the base terminal. Accordingly, in this embodiment, for example, there may be used as the switching element 31 a photo coupler which can transmit electrical signals with the controller electrically insulated from the connection wire 11 by converting the electrical signals to optical signals.

Otherwise this embodiment has the same configurations and effects as the first embodiment. It will be noted that, of the symbols used in the description and the drawing of this embodiment, the same symbols are used for the same elements as the first embodiment unless otherwise noted.

Fourth Embodiment

Figure 8:
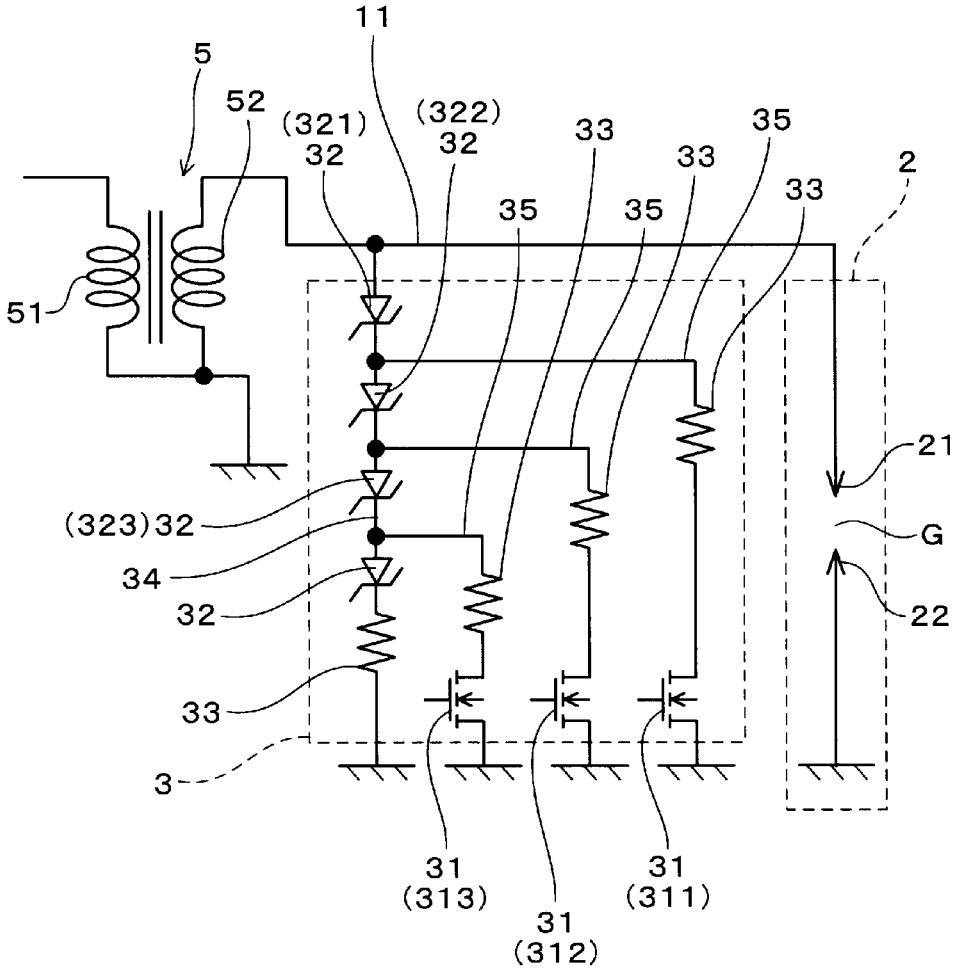
FIG. 8 is a schematic circuit diagram of an ignition system of a fourth embodiment.

This embodiment, as shown in FIG. 8, is an example where the wiring structure of the voltage regulating elements 32 and the switching elements 31 in the voltage limiter 3 is modified.

That is, in this embodiment, a series unit 34 is connected between the connection wire 11 and the ground, and a plurality of voltage regulating element 32 are connected in series in the series unit 34. The series unit 34 branches from between the adjacent voltage regulating element 32 to branch units 35. Each branch unit 35 has the switching element 31 and the resistor 33 connected in series. Further, in the series unit 34, the resistor 33 is connected to the switching elements 31 in series.

Here, the voltage regulating elements 32, in order from the element 32 closest to the connection wire 11, are referred to a first voltage regulating element 321, a second voltage regulating element 322 and a third voltage regulating element 323. Similarly, the switching elements 31, in order from the switching element 31 in the branch unit 35 whose branch point is closest to the connection wire 11, are referred to a first switching element 311, a second switching element 312 and a third switching element 313.

The voltage limiter 3 sets the switching elements 31 to the on or off state to obtain the voltage limit value VL, depending on the cumulative usage time of the ignition plug 2. For example, the voltage limiter 3 sets only one of the switching elements 31 to the on state or all the switching elements 31 to the off state, thereby obtaining stepwise voltage limit values VL. Specifically, firstly the voltage limiter 3 sets only the first switching element 311 to the on state and the other switching elements 312 and 313 be to the off state to obtain the voltage limit value VL set at the specified voltage of the first voltage regulating element 321. Next, the voltage limiter 3 sets only the second switching element 312 to the on state and the other switching elements 311 and 313 to the off state to obtain the voltage limit value VL set at the sum of the specified voltages of the first and second voltage regulating elements 321 and 322. Similarly, the voltage limit value VL set at the sum of the specified voltages of the first, second and third voltage regulating elements 321, 322 and 323 can be obtained by setting only the third switching element 313 to the on state and the other switching elements 311 and 312 to the off state. The voltage limit value VL set at the sum of the specified voltages of all the voltage regulating elements 32 can be obtained by setting all the switching elements 31 be off state. Thus, the voltage limiter 3 can stepwisely increase the voltage limit value VL.

In this embodiment, the specified voltage of the first voltage regulating element 321 is the initial voltage limit value VL of the ignition plug 2, and the specified voltages of the other voltage regulating elements 32 are the difference values (incremental values) between the voltage limit values VL before and after switching. Accordingly, as the voltage regulating elements 32 other than the first voltage regulating element 321, voltage regulating elements having specified voltages smaller than that of the first voltage regulating element 31 are used.

In this embodiment, the voltage limiter 3 has four voltage regulating elements 32 and three switching elements 31, and can change the voltage limit value VL to four levels. However, applications of this disclosure are not limited to this. For example, the number of voltage levels of the voltage limit value for switching can be changed by changing the number of the voltage regulating elements and the switching elements in the configuration where the a plurality of voltage regulating elements are connected in series.

Otherwise this embodiment has the same configurations and effects as the first embodiment. It will be noted that, among the symbols used in the description and the drawing of this embodiment, the same symbols are used for the same elements as the first embodiment unless otherwise noted.

Though the invention has been described with respect to the specific preferred embodiments, many variations and modifications will become apparent to those skilled in the art upon reading the present application. It is therefore the intention that the claims be interpreted as broadly as possible in view of the prior art to include all such variations and modifications. For example, the voltage limiter 3 can be provided in the ignition coil 5 or the ignition plug 2.

The invention claimed is:

1. An ignition system, comprising:

an ignition coil unit having a primary coil and a secondary coil which are magnetically coupled with each other;

an ignition plug having a center electrode and a ground electrode and generating spark discharge including capacitive discharge between the center and ground electrodes to which voltage is applied on the basis of the magnetic energy accumulated in the ignition coil unit, the applied voltage being caused by electrical energy supplied from the ignition coil; and a voltage limiter that limits an absolute value of the voltage applied to the electrodes of the ignition plug to a voltage limit value for reduction of a current based on the capacitive discharge, the voltage limiter increasing the voltage limit value as cumulative usage time of the ignition plug increases.

2. The ignition system according to claim 1, wherein the voltage limiter has a switching element and a plurality of voltage regulating elements, and controls the switching element to change the voltage limit value to different levels.

3. The ignition system according to claim 1, wherein the voltage limiter changes the voltage limit value to three or more levels.

4. The ignition system according to claim 1, wherein the voltage limiter is connected to a connection wire which connects the ignition coil and the ignition plug.

5. The ignition system according to claim 1, wherein the voltage limiter counts a duration until the spark discharge occurs, and changes the voltage limit value on the basis of the counted duration.

* * * * *